US011162313B2

(12) United States Patent
Clemens et al.

(10) Patent No.: US 11,162,313 B2
(45) Date of Patent: Nov. 2, 2021

(54) ANCHOR FOR A DOWNHOLE LINEAR ACTUATOR

(71) Applicant: Halliburton Energy Services, Inc., Houston, TX (US)

(72) Inventors: Jack Gammill Clemens, Fairview, TX (US); Mark Holly, The Colony, TX (US); Nathan J. Harder, Powell, WY (US)

(73) Assignee: Halliburton Energy Services, Inc., Houston, TX (US)

( * ) Notice: Subject to any disclaimer, the term of this patent is extended or adjusted under 35 U.S.C. 154(b) by 308 days.

(21) Appl. No.: 15/992,499

(22) Filed: May 30, 2018

(65) Prior Publication Data

US 2019/0017340 A1 Jan. 17, 2019

Related U.S. Application Data

(60) Provisional application No. 62/532,024, filed on Jul. 13, 2017.

(51) Int. Cl.
*E21B 23/01* (2006.01)

(52) U.S. Cl.
CPC ..... *E21B 23/01* (2013.01)

(58) Field of Classification Search
CPC ..... E21B 23/01; E21B 33/129
See application file for complete search history.

(56) References Cited

U.S. PATENT DOCUMENTS 3,303,885 A * 2/1967 Kisling, III ..... E21B 33/1293 166/134
3,572,442 A * 3/1971 Templeton ..... E21B 23/01 166/217
5,095,979 A * 3/1992 Perricone ..... E21B 23/006 166/138
5,390,737 A * 2/1995 Jacobi ..... E21B 29/00 166/131
5,487,427 A * 1/1996 Curington ..... E21B 23/01 166/217
5,492,173 A * 2/1996 Kilgore ..... E21B 23/06 166/66.4
5,701,954 A * 12/1997 Kilgore ..... E21B 23/01 166/119

(Continued)

OTHER PUBLICATIONS

"Retract" definition available from: https://www.thefreedictionary.com/retract (Year: 2020).*

*Primary Examiner* — Blake E Michener
*Assistant Examiner* — Theodore N Yao
(74) *Attorney, Agent, or Firm* — Kilpatrick Townsend & Stockton LLP

(57) ABSTRACT

An anchor for a linear actuator includes a body, a mandrel with at least two slip-receiving portions, and one or more slips. The body can be coupled to the linear actuator and the mandrel can be coupled to the power rod of the linear actuator. The linear actuator can power on and cause the power rod to move in an uphole direction toward the linear actuator. Moving the power rod can cause the mandrel to move in an uphole direction. The slip can respond to the mandrel moving in an uphole direction by expanding outward. The mandrel can continue to move in the uphole direction until the slip is received at a second slip-receiving portion.

15 Claims, 9 Drawing Sheets

(56) References Cited

U.S. PATENT DOCUMENTS

| | | | | |
|---|---|---|---|---|
| 6,354,372 | B1 * | 3/2002 | Carisella | E21B 23/01 166/118 |
| 8,714,242 | B2 | 5/2014 | Miller | |
| 9,109,435 | B2 | 8/2015 | O'Connor et al. | |
| 2010/0155050 | A1 * | 6/2010 | Frazier | E21B 23/06 166/102 |
| 2010/0263876 | A1 * | 10/2010 | Frazier | E21B 33/129 166/378 |
| 2011/0146970 | A1 | 6/2011 | Hallundbaek et al. | |
| 2012/0298378 | A1 * | 11/2012 | McCauley | E21B 23/01 166/382 |
| 2013/0220597 | A1 | 8/2013 | Miller | |
| 2013/0299160 | A1 * | 11/2013 | Lott | E21B 23/04 166/88.2 |
| 2014/0102719 | A1 | 4/2014 | Hallunbaek | |
| 2014/0224477 | A1 * | 8/2014 | Wiese | E21B 33/129 166/179 |

* cited by examiner

ANCHOR FOR A DOWNHOLE LINEAR ACTUATOR

CROSS-REFERENCE TO RELATED APPLICATION

This claims priority from commonly owned provisional patent application No. 62/532,024, titled "Anchor for Downhole Power Unit" and filed Jul. 13, 2017, the entire disclosure of which is incorporated herein by reference.

TECHNICAL FIELD

The present disclosure relates generally to devices for use in wells. More specifically, but not by way of limitation, this disclosure relates to an anchor device for use with a linear actuator such as a downhole power unit.

BACKGROUND

A linear actuator is used in wells to provide extra pulling force for tools already located further downhole in the wellbore in order to prevent excessive stretching of a wireline, slickline, or coiled tube that is being used to run tools downhole. A linear actuator can be battery powered or be connected to a cable that supplies power from the surface or elsewhere in in the well system. A linear actuator does not necessarily need to be fixed in place. But, a linear actuator can be retained in place by installing a downhole bridge plug or a packer, either of which can serve as a barrier within the wellbore tubing. The linear actuator itself can then be run in to the position of the barrier on wire or tubing and be used to shift sleeves, pull fish, or pull crown plugs.

DETAILED DESCRIPTION

Figure 1:
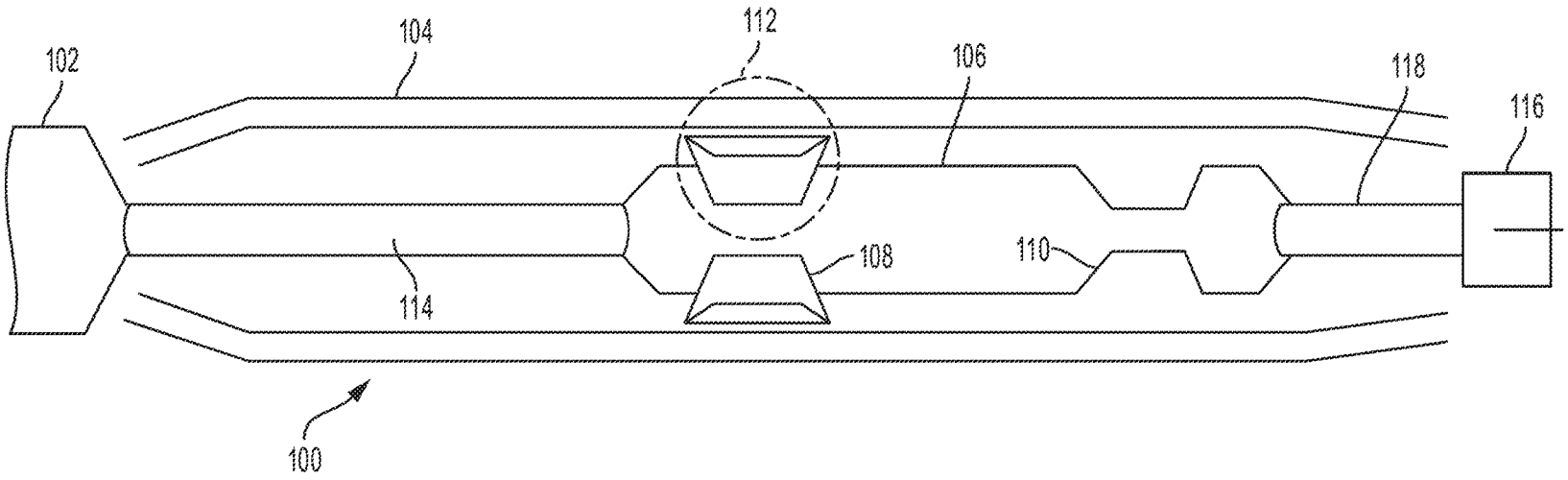
FIG. 1 is a schematic, cross-sectional view of an anchor device according to some aspects of the present disclosure.

Certain aspects and features relate to an anchor device for a linear actuator that allows the linear actuator unit to have versatile applications in a wellbore without requiring the linear actuator to be run downhole via coiled tubing and wireline tractors with strokers. The anchor device can also eliminate the need for a downhole bridge plug or a packer to serve as a barrier within the wellbore tubing to retain the linear actuator in place.

An anchor device according to some examples can be run on slickline, eline, or coiled tubing, and can be attached to a battery-powered linear actuator that does not require surface power. An anchor can provide a low-cost alternative to coiled tubing and wireline tractors with strokers, and potentially provide low rig-up cost and small rig-up footprint.

In one example, the anchor includes a body, a mandrel with at least two slip-receiving portions, and one or more slips. The slip-receiving portions can be portions of the mandrel with a smaller diameter than other portions of the mandrel with a larger diameter, or the diameter of the slip-receiving portions may be the same diameter as the other portions of the mandrel. The body can be coupled or configured to couple to the linear actuator and the mandrel can be coupled to a power rod of the linear actuator on a first end, and coupled via a connector to a gripping tool on a second end. After the gripping tool couples to another adaptor or tool, the linear actuator can power on and cause the power rod to move in an uphole direction toward the linear actuator. Moving the power rod can cause the mandrel to move in an uphole direction. The slip, which may be initially received at the first slip-receiving portion, can respond to the mandrel moving in an uphole direction by expanding outward from a first slip-receiving portion of the mandrel. The mandrel can continue to move in the uphole direction until the slip is received at a second slip-receiving portion, at which point the linear actuator and anchor (along with any tool or adaptor coupled to the gripping tool) can be removed from the wellbore.

In some examples, multiple slips are distributed around the mandrel between the mandrel and the body. Linkages can be connected to the slips for causing the slips to expand. At least one wedge can be disposed at least partly between each of the slips and the mandrel for causing the slips to expand. Each slip can include a slip body and a slip insert shaped and sized to fit at least partially into the slip body. In such an arrangement, the slip insert can be selected from among multiple alternative slip inserts of varying characteristics, such as thickness, material, or various types of gripping surfaces.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a schematic, cross-sectional view of an anchor device 100 according to aspects of the present disclosure.

The anchor device can be coupled downhole to the linear actuator 102 (i.e., uphole is to the left in FIG. 1 and downhole is to the right). In this example, the linear actuator is a downhole power unit (DPU®), however, it should be appreciated that any type or brand of linear actuator can be used. The anchor device includes a body 104 coupled to the DPU, a mandrel 106 with a first slip-receiving portion 108, a second slip-receiving portion 110, and slips 112. The mandrel 106 is coupled to a DPU power rod 114 on a first end and to a connector 116 for a downhole tool that includes a shaft 118 on the second end (downhole end). When the DPU power rod 114 is activated and moved in the direction of the arrow, an uphole direction, the slips 112 can expand during the initial stroking of the power rod uphole. The anchor device can hold the DPU 102 in place in the wellbore but permit the DPU power rod 114 to continue traveling uphole. The linear force or stroke can be applied to the power rod 114 using the DPU 102 after the anchor has been set and can be used manipulate a tool downhole, for example to shift or pull devices in the wellbore by using a gripping tool. The anchor device 100 can be reconfigured to be used while the power rod 114 is moving inward or outward.

The initial few inches of stroke can be used to expand the anchor device that locks the tool assembly against the inner diameter of the tubing. Once the anchor device is locked into the tubing, the inward (i.e., uphole) stroke can continue. This linear movement can be used to shift sleeves, pull plugs, etc. When the anchor device is operating with the mandrel 106 and power rod 114 moving uphole in the direction of the arrow in FIG. 1, the slips 112 expand from the first slip-receiving portion 108 of the mandrel 106 to apply force to tubular body 104 and anchor the DPU contemporaneously with the mandrel 106 and the power rod 114 moving. Linear force is applied to the power rod 114 using the DPU 102, with the linear force ultimately being applied to the connected downhole tool. This linear force further causes the mandrel 106 to move relative to the slips 112 and the tubular body 104. The slips 112 are then retracted towards the second slip-receiving portion 110 of the mandrel 106. At the end of the stroke, the anchor device can be released and the toolstring is free to be pulled out of the hole.

Figure 2:
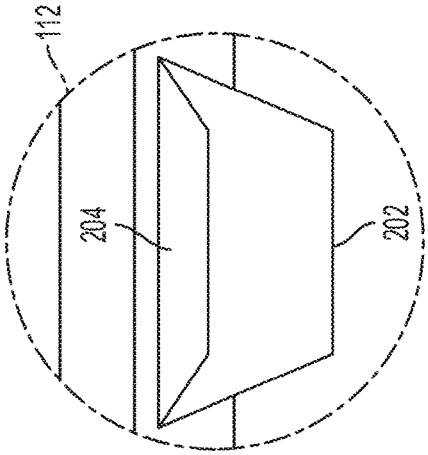
FIG. 2 is a schematic, cross-sectional view of a slip for an anchor device according to some aspects of the present disclosure.

The slip may be a solid piece of material, such as metal. In such a case, the slip may have a textured surface with which to engage the inner diameter of the anchor device body. But, optionally, the slip may be a two-piece slip. FIG. 2 is a schematic, cross-sectional view of slip 112 for the anchor device 100 according to some aspects. Slip 112 is a two-piece slip. The two-piece slip in this example includes a slip body 202 and a slip insert 204. The slip insert 204 can permit tubing size and weight changes. The slip insert 204 can also be selected from among multiple alternative slip inserts of varying characteristics, such as thickness, material, or various types of gripping surfaces. In some examples, the slip can be self-energizing.

The slip 112 can be pushed outward with the profile on the power rod 114 or the mandrel 106 as the DPU power rod 114 travels inward. Multiple slips 112 can be distributed around the tool. In some examples, three or five slips can be provided around the mandrel 106 between the mandrel and the body 104. Any number of slips can be used, but the anchor device may tend to have greater stability with an odd number of slips. In the case of a two-piece slip, each slip insert can have a body that carries the insert. The slips can be "floating" with springs so that when the slips contact the tubing or casing inner diameter, the slips can slide up a profile in the body 104 and "self-energize." Estimated setting force for the slips may be approximately 12,000 to 15,000 pounds of force to hold the DPU stroke force. The setting force may be limited with expansion of the slips. The slips may be either shimmed for different inside diameters or replaced. If a two-piece slip is used, the insert may be replaced. The slip body 202 can slide relative to the power rod 114. Friction reduction components such as bushings or roller bearings can be included between the slip body 202 and the power rod 114 to minimize slip drag on the power rod 114. The drag of the slip bodies 202 on the power rod 114 can reduce the net pulling force of the DPU 201. Slips can extend out without riding the DPU power rod to prevent a drag load on the power rod during stroking.

Figure 3:
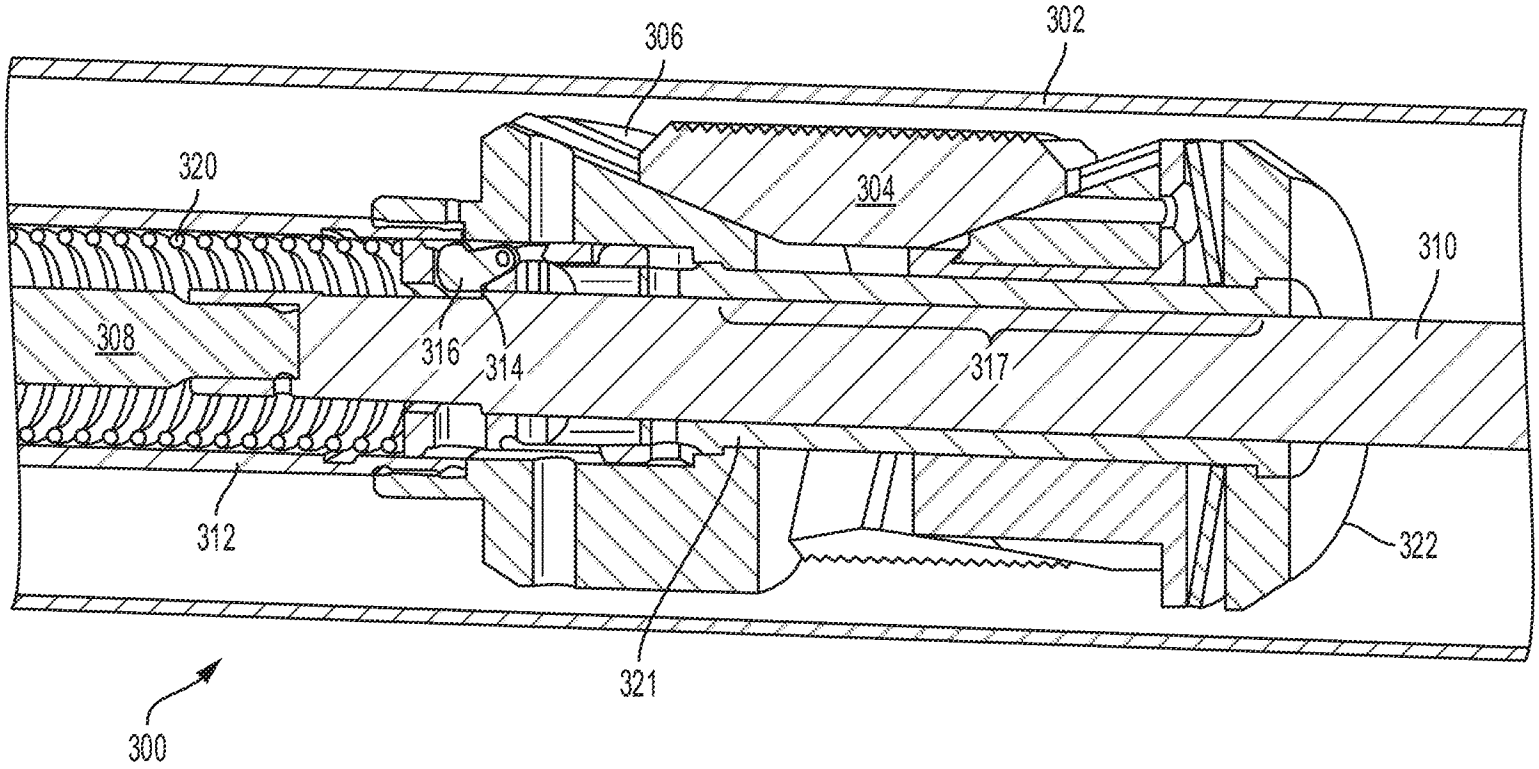
FIG. 3 is a close-up, cross-sectional view of a portion of an anchor device with slips retracted according to some aspects of the present disclosure.

FIGS. 3 to 7 illustrate an example of an anchor device 300 in various states of operation. As before, the uphole direction is to the left. FIG. 3 is a close-up, cross-sectional view of a portion of an anchor device with slips retracted. Anchor device 300 includes a tubular body 302. Anchor device 300 includes a plurality of slips 304. The slips are activated by sliding wedge 306 moving in an axial direction. Power rod 308 connects to a DPU as previously shown and discussed. Mandrel 310 ultimately connects to a downhole tool (not shown) as previously discussed. Power rod 308 and mandrel 310 pass inside a housing portion, specifically in this view, first housing portion 312. In operation, the slips 304 are pushed outward by the profile on mandrel 310, in this example, a step 314. This change in profile causes rotation of dog 316. Dog 316 is a part that is shaped and sized to be an engagement mechanism for sliding wedge 306, which in turn moves sliding wedge 306, disposed partly between the slip 304 and the first slip-receiving portion 317 of mandrel 310. Force is exerted by spring 320 on sliding wedge 306. The force from spring 320 causes slips 304 to float and ultimately exert force on the inner diameter of tubular body 302. First slip-receiving portion 317 of mandrel 310 is inside a second housing portion 321. The parts around the second housing portion 321 are held in place by retainer 322 and washer 324.

Figure 4:
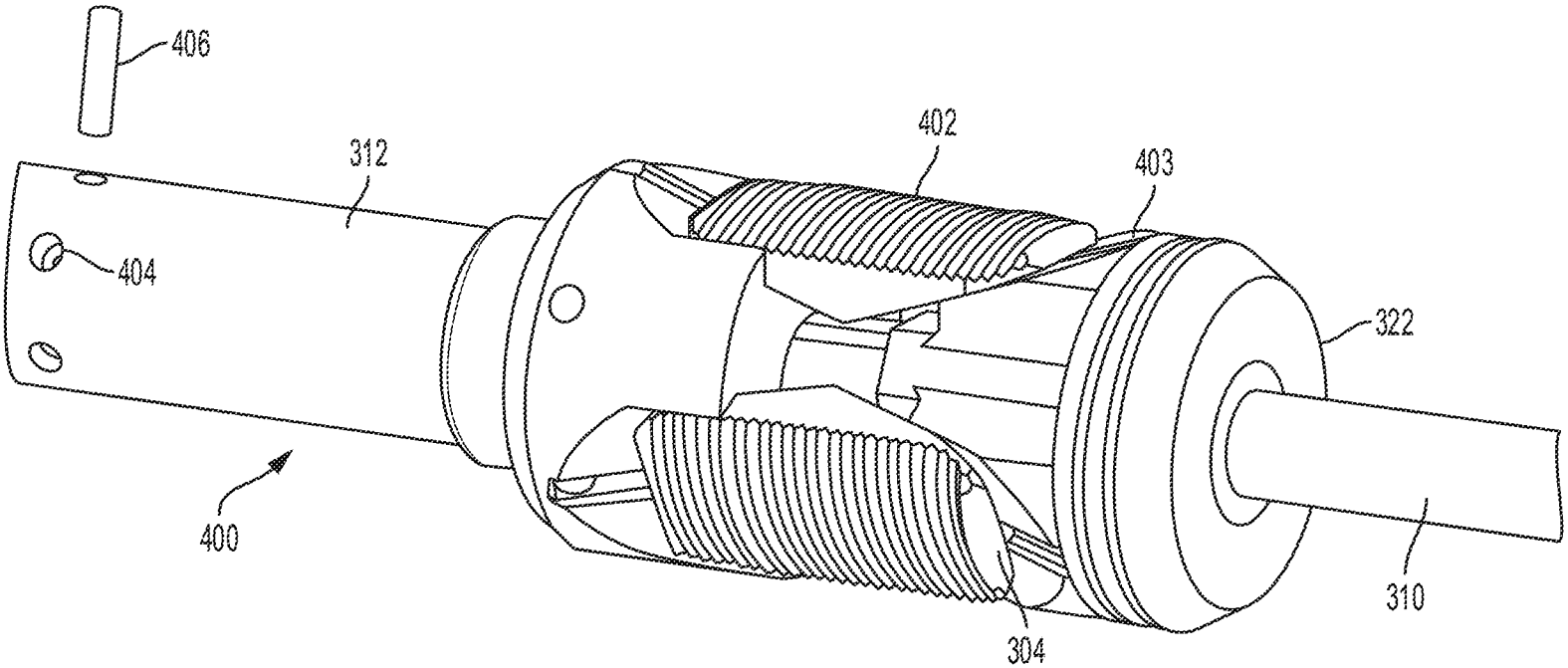
FIG. 4 is it a perspective view of a slip arrangement of the anchor device as shown in FIG. 3 according to some aspects of the present disclosure.

FIG. 4 is it a perspective view of the slip arrangement 400 of the anchor device shown in FIG. 3 according to some aspects. In FIG. 4, two slips 304 are almost fully visible. Each slip 304 has a textured surface 402 with which to engage the inner diameter of the tubular body 302. Slips 304 are solid parts. In other embodiments, a two-piece slip could be used, in which the textured surface is a portion of the slip insert. In FIG. 4, mating wedges 403 are visible. Mating wedges 403 are distributed one per slip and allow the slip to expand evenly when sliding wedge 306 moves. Also visible in FIG. 4 are holes 404 that accept shear pins 406. Shear pins 406 act as a shear release mechanism to retain spring 320 during normal operation of the anchor device. In the event of a jarring force within the system, shear pins 406 automatically release, causing the anchor device to release the slips 304 because the spring force is being removed. This mechanism serves as an emergency release feature to protect the anchor device and downhole tool from becoming jammed or broken due to sudden, unforeseen forces.

The emergency release feature can be incorporated to reduce risk in a case where the DPU fails while the slips are expanded. Note that latch tools that can be attached below the anchor device can have either an emergency jar release or hydraulic release feature that can "jar" the anchor device and trigger the emergency release feature either automatically or at the command of an operator. A slickline latch tool for crown plugs can have a hydraulic release feature that releases from the crown plug for emergency release. Various latch tools can have a jar release mechanism as well. Sleeve shifting tools can also have a shear release feature. Down jarring or up jarring can also release or unload the anchor slips back towards the slip receiving portion of the mandrel.

Figure 5:
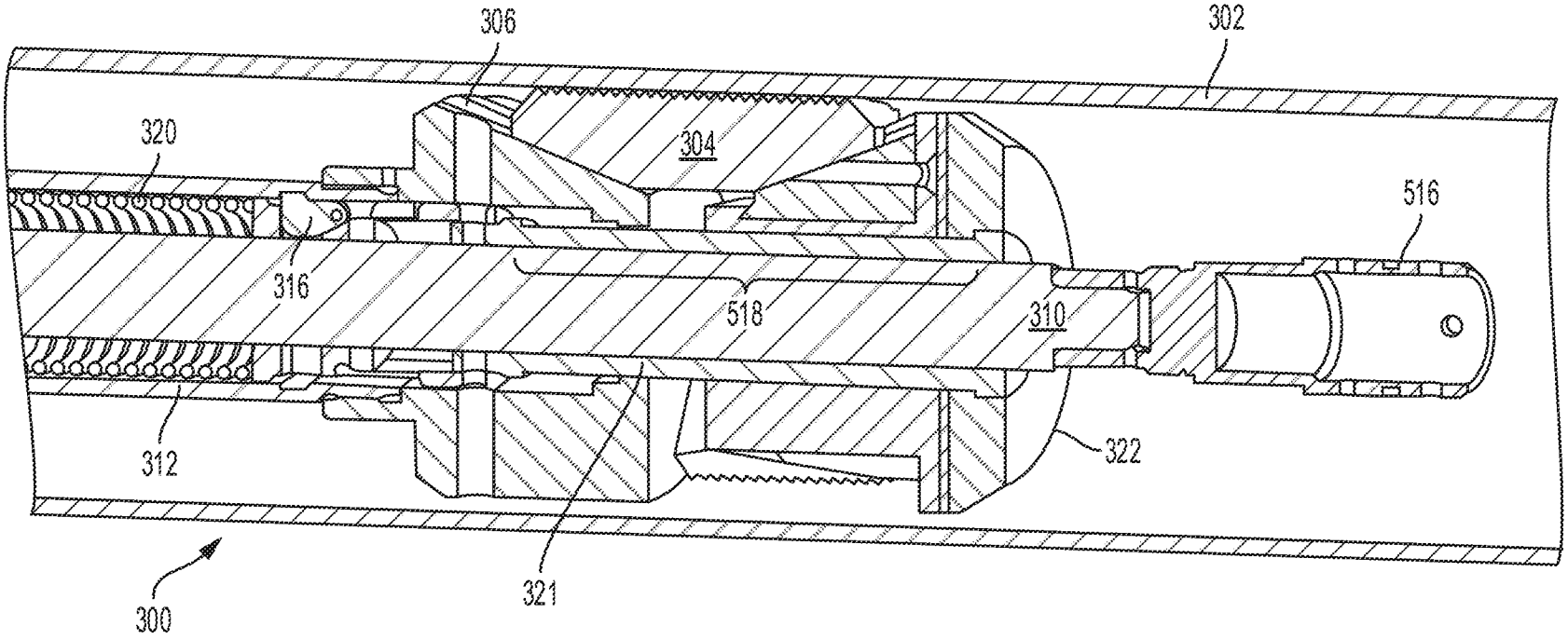
FIG. 5 is a close-up, cross-sectional view of a portion of an anchor device with slips expanded to apply pressure to a tubular body according to some aspects of the present disclosure.

FIG. 5 is a close-up, cross-sectional view of a portion of an example of the anchor device 300 with slips 304 expanded to apply pressure to a tubular body 302. A slip 304 is readily visible engaged against the inner diameter of tubular body 302. The slips 304 have been expanded from a first slip-receiving portion 518 of the mandrel 310 to apply force to the tubular body 302. A linear force is being applied to the power rod using the DPU. The linear force can be further be applied to any downhole tool fastened to downhole tool connector 516 and can be further cause the mandrel 310 to move relative to the slips 304 and the tubular body 302. Ultimately, the slips 304 can be retracted towards the first slip-receiving portion 518 of mandrel 310.

Figure 6:
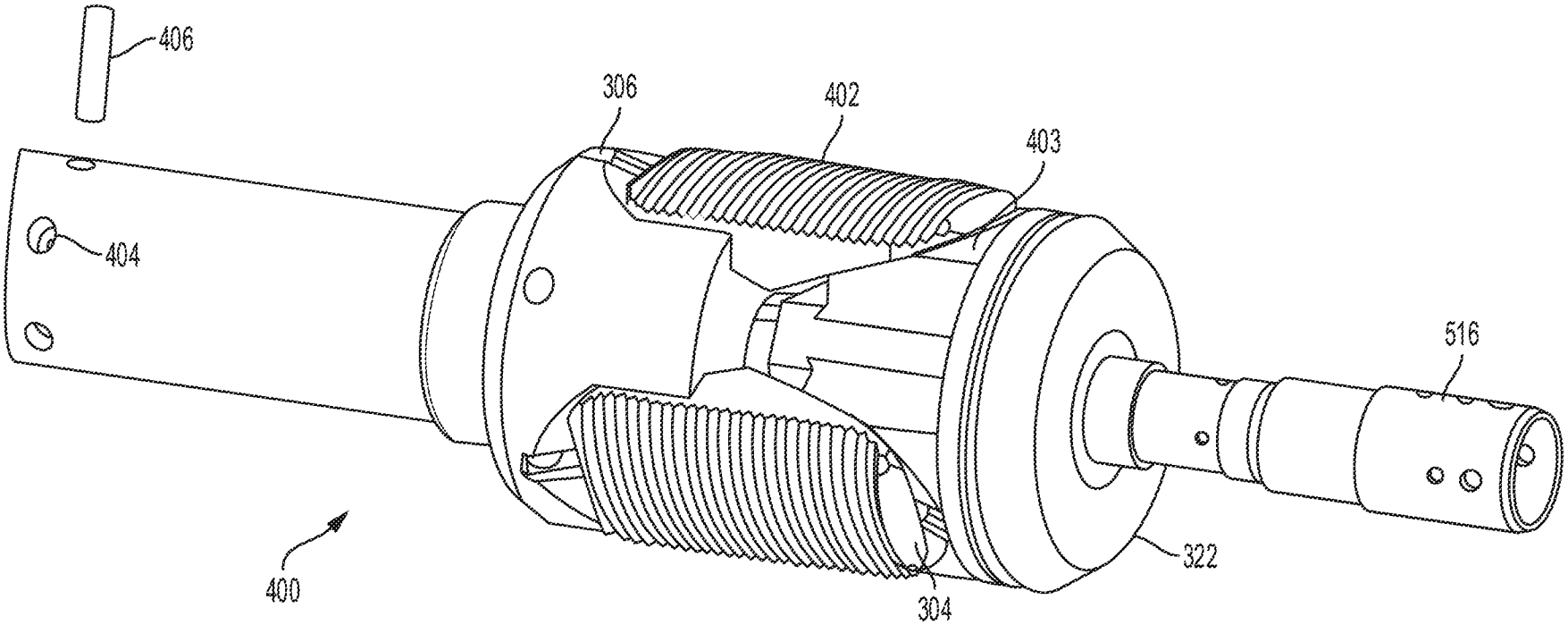
FIG. 6 is a perspective view of a slip arrangement for the anchor device as shown in FIG. 5 according to some aspects of the present disclosure.

FIG. 6 is it a perspective view of the slip arrangement 400 of the anchor device as shown in FIG. 5. In this case, the slips 304, two of which are almost fully visible, are expanded. Each slip 304 has a textured surface 402 with which to engage the inner diameter of the tubular body 302. Slips 304 are solid parts. Since the mandrel has moved as previously described, connector 516 is visible in FIG. 6. Also visible in FIG. 6 are holes 404 that accept shear pins 406.

Figure 7:
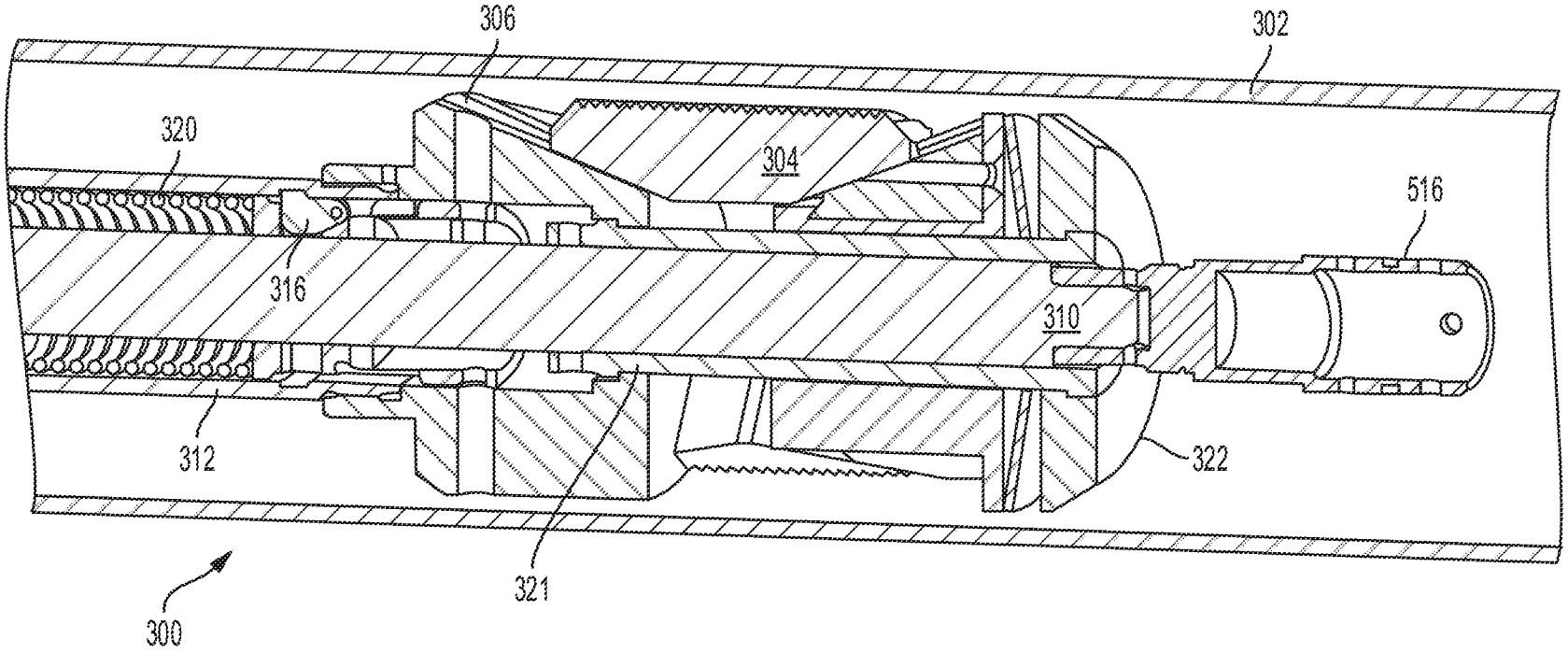
FIG. 7 is a close-up, cross-sectional view of a portion of an anchor device with the slips released according to some aspects of the present disclosure.

FIG. 7 is a close-up, cross-sectional view of a portion of the anchor device 300 with the slips 304 released by the emergency release feature, as can be appreciated by observing that mandrel 310 is pulled all the way to the left into second housing portion 321. As previously discussed, the emergency release feature can be incorporated to reduce risk if damage or failure while the slips are expanded.

Figure 8:
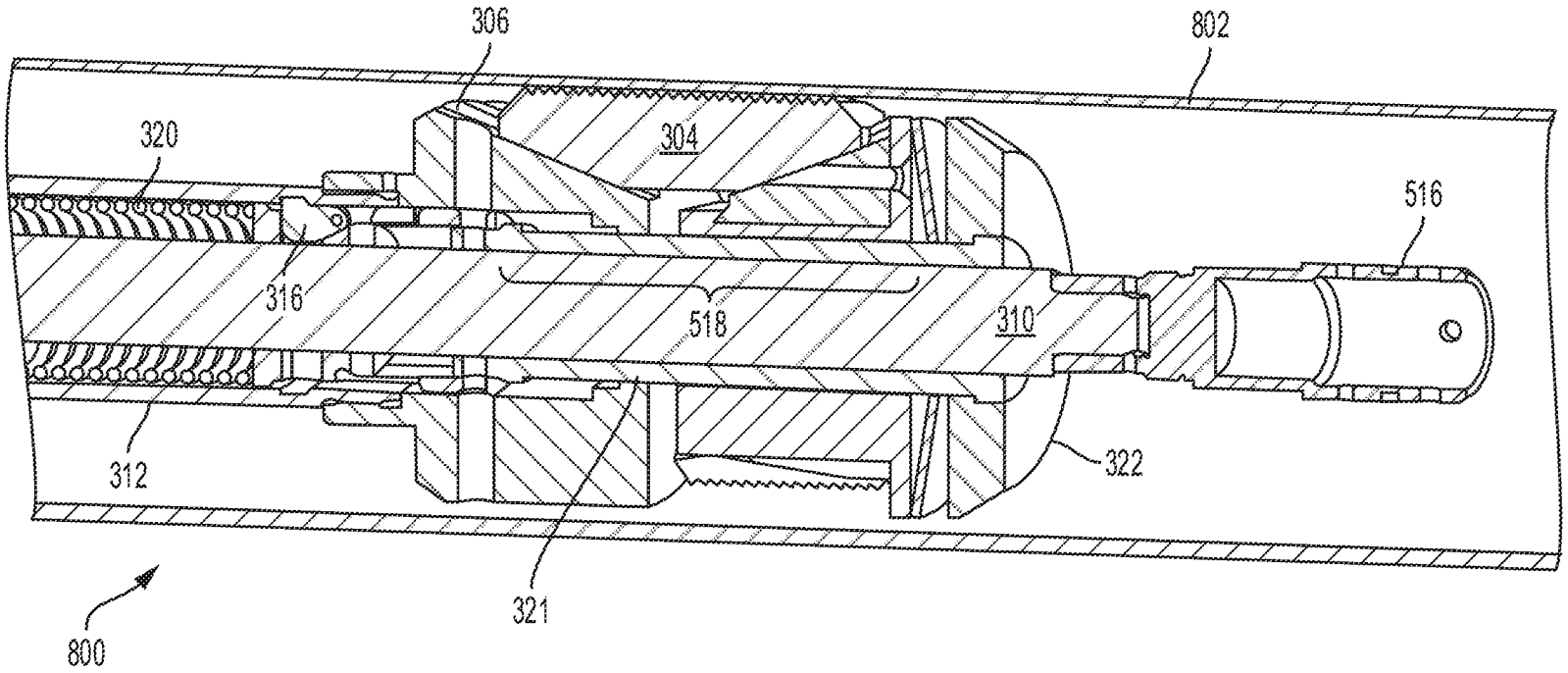
FIG. 8 is a close-up, cross-sectional view of a portion of an anchor device with slips expanded to apply pressure to a relatively thin tubular body according to some aspects of the present disclosure.

FIG. 8 is a close-up, cross-sectional view of a portion of an example of an anchor device 800 with slips 304 expanded to apply pressure to a relatively thin tubular body 802. Anchor device 800 of FIG. 8 is identical to anchor device 300 of FIG. 3 and FIG. 5 in every respect except that it makes use of the thinner tubular body 802. The slips 304 are thus expanded further away from mandrel 310 as can be appreciated by observing the position of slips 304 relative to sliding sedge 306 as compared to that shown in FIG. 5.

Figure 9:
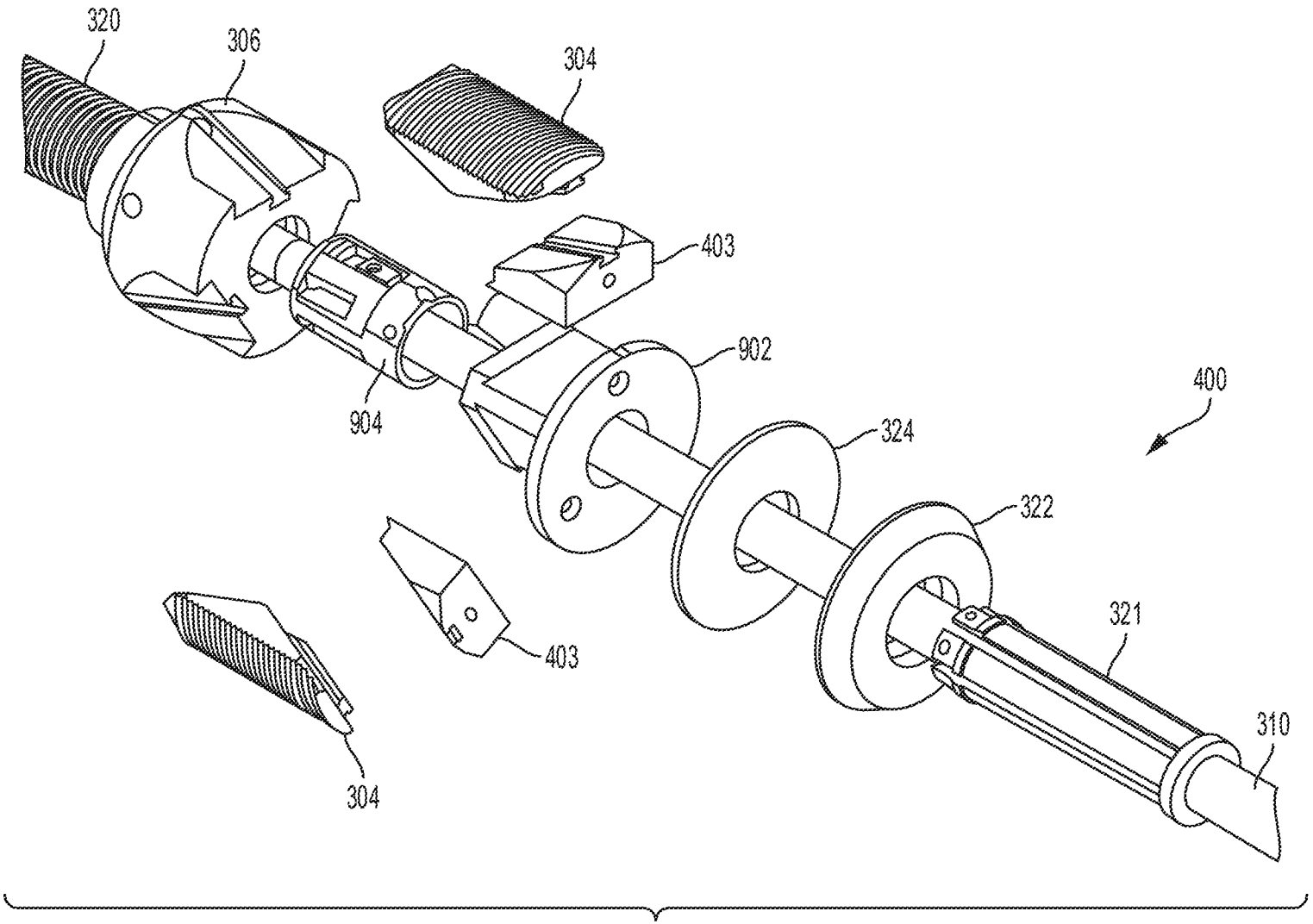
FIG. 9 is an exploded view of a slip arrangement for an anchor device according to some aspects of the present disclosure.

FIG. 9 is an exploded view of a slip arrangement 400 of an example of the anchor device 300. Additional parts visible in this view include bushing 902 and housing latch 904. Housing latch 904 connects second housing portion 321 to the first housing portion, not shown in this view. Other parts have already been described.

Figure 10:
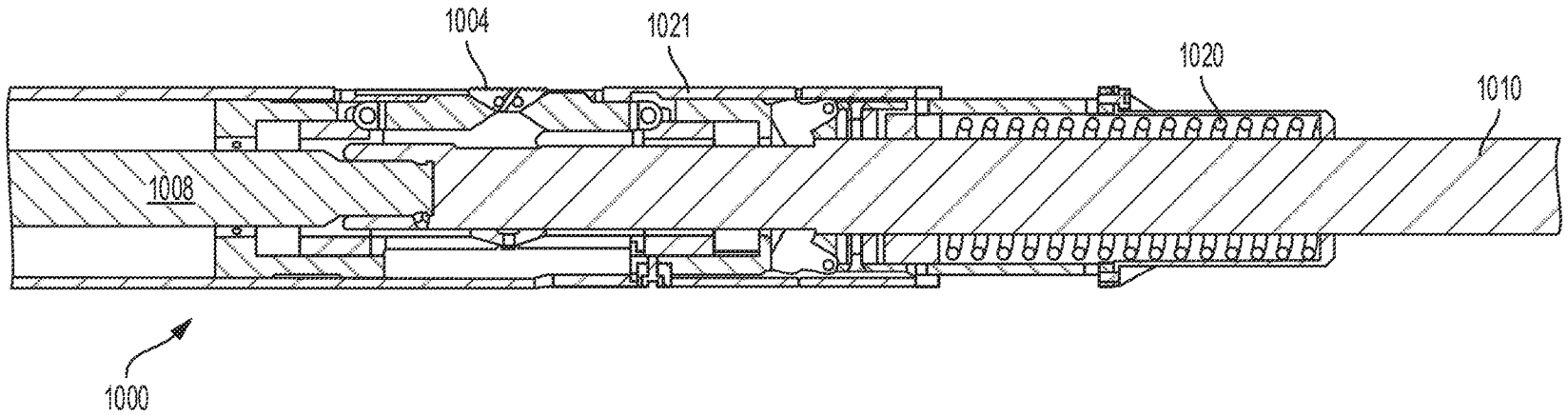
FIG. 10 is a close-up, cross-sectional view of a portion of a high-expansion anchor device with slips retracted according to some aspects of the present disclosure.
Figure 11:
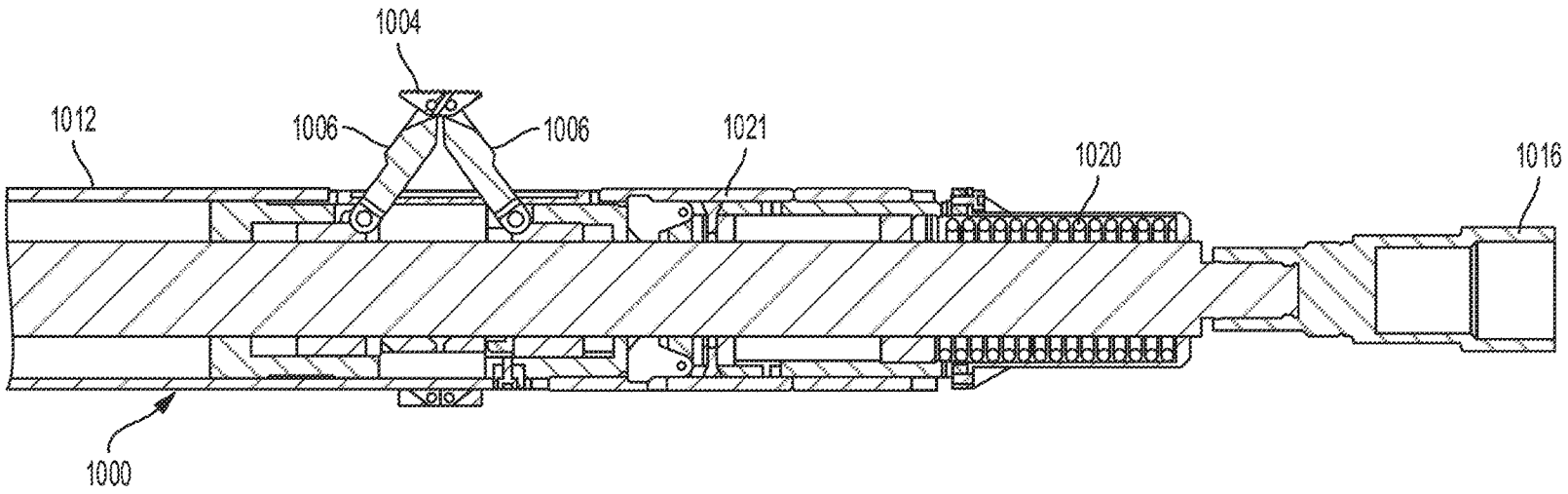
FIG. 11 is a close-up, cross-sectional view of a portion of the high-expansion anchor device shown in FIG. 10 with slips expanded to apply pressure to a tubular body according to some aspects of the present disclosure.

FIG. 10 and FIG. 11 are cross-sectional views of an example, high expansion anchor device 1000. Anchor device 1000 includes slips 1004 that are operated by slip linkages 1006. Power rod 1008 is connected to mandrel 1010 running within a first housing portion 1012 and a second housing portion 1021. Spring 1020 provides the force to operate slips 1004. A connector 1016 is provided for downhole tools. In other respects, the operation of the anchor device 1000 is similar to that of the devices already discussed. Anchor device 1000 is shown with slips retracted in FIG. 10 and with slips expanded in FIG. 11. In operation, slip linkages 1006 extend to expand slips 1004 and apply force to the tubular body (not shown). Slip linkages 1006 allow the slips 1004 or to protrude farther away from the slip receiving region of the mandrel, providing an anchor tool that will work with bodies that have a large diameter relative to the slip arrangement of the anchor device as compared to those shown herein where the slips are extended using wedges.

A standard DPU that is already in the field may be configured with the anchor devices described herein and may use the same logic that is currently being used to control the DPU, although using the same logic used in a standard DPU may limit the anchor to a single inward stroke event. Such a DPU can be run on slickline wire that has no telemetry to surface. Modifications to the logic to better accommodate the anchor device described herein can permit multiple events on one trip downhole. Also, surface controls that are monitored in real time through the wire can permit starting, stopping, and redirecting the stroke. These control functions may be performed with standard eline cable or digital slickline.

Terminology used herein is for the purpose of describing particular embodiments only and is not intended to be limiting. As used herein, the singular forms "a," "an," and "the" are intended to include the plural forms as well, unless the context clearly indicates otherwise. It will be further understood that the terms "comprises" or "comprising," when used in this specification, specify the presence of stated features, steps, operations, elements, or components, but do not preclude the presence or addition of one or more other features, steps, operations, elements, components, or groups thereof. Additionally, comparative, quantitative terms such as "above," "below," "less," and "greater" are intended to encompass the concept of equality, thus, "less" can mean not only "less" in the strictest mathematical sense, but also, "less than or equal to."

Positional terms such as, but not limited to, "left" and "right" are not meant to imply any absolute positions. An element can be functionally in the same place in an actual device, even though one might refer to the position of the element differently due to the instant orientation of the device. Indeed, the anchor device assembly described herein may be oriented in any direction, especially when not in use, and the terminology, therefore, should be understood as encompassing such variations unless specified otherwise. Elements that are described as "connected" or "connectable" can be connected directly or through intervening elements.

In some aspects, an anchor for a linear actuator is provided according to one or more of the following examples. As used below, any reference to a series of examples is to be understood as a reference to each of those examples disjunctively (e.g., "Examples 1-4" is to be understood as "Examples 1, 2, 3, or 4").

Example #1

An assembly for use in a wellbore, where the assembly includes a body configured to couple to a linear actuator and defining an inner area, a mandrel positionable in the inner area and configured to couple on a first end to a power rod of the linear actuator and on a second end to a shaft for a downhole tool, the mandrel including a first slip-receiving portion and a second slip-receiving portion, and a slip that is expandable from a position in the first slip-receiving portion in response to the power rod moving in an uphole direction and for being received in the second slip-receiving portion.

Example #2

The assembly of example 1, wherein the mandrel includes a portion between the first slip-receiving portion and the second slip-receiving portion that has a larger diameter than the first slip-receiving portion and the second slip-receiving portion.

Example #3

The assembly of example(s) 1-2 wherein including multiple slips distributed around the mandrel.

Example #4

The assembly of example(s) 1-3 further including a linkage connected between the slip and the mandrel, the linkage for causing the slip to expand.

Example #5

The assembly of example(s) 1-4 further including a wedge disposed partly between the slip and the slip receiving portion for causing the slip to expand.

Example #6

The assembly of example(s) 1-5 further including an engagement mechanism that is responsive to movement of the power rod to engage the wedge and cause the wedge to move in an axial direction and cause the slip to expand.

Example #7

The assembly of example(s) 1-6 wherein the slip includes a slip body and a slip insert shaped and sized to fit at least partially into the slip body, wherein the slip insert can be selected from among a plurality of slip inserts of varying characteristics.

Example #8

The assembly of example(s) 1-7 further including the linear actuator coupled to the body.

Example #9

The assembly of example(s) 1-8 further including a shear release mechanism to release the mandrel in response to a jarring force.

Example #10

A method of manipulating a downhole tool includes expanding multiple slips from a first slip-receiving portion of a mandrel to apply force to a tubular body, wherein the mandrel is connected to a power rod connected to a linear actuator, applying a linear force to the power rod using the linear actuator, wherein the linear force is being applied to the downhole tool and further causing the mandrel to move relative to the slips and the tubular body, and retracting the slips towards a second slip-receiving portion of the mandrel.

Example #11

The method of example 10-11 wherein the slips are expanded by extending slip linkages, each slip linkage connected to a slip.

Example #12

The method of example(s) 10-12 wherein the slips are expanded by sliding a wedge.

Example #13

The method of example(s) 10-12 wherein the wedge is slid by an engagement mechanism that is responsive to movement of the power rod.

Example #14

The method of example(s) 10-13 further including releasing the mandrel in response to a jarring force.

Example #15

The method of example(s) 10-14 wherein the mandrel is released by withdrawing a plurality of shear pins.

Example #16

A system includes a linear actuator coupled to or including a power rod, a mandrel positioned in a tubular body, the mandrel coupled to the power rod on a first end and configured to couple to a shaft for a downhole tool on a second end, and multiple slips distributed around the mandrel between the mandrel and the tubular body, the slips being expandable outward from the mandrel to a position against the tubular body to apply force to the tubular body and anchor the linear actuator contemporaneously with the mandrel and the power rod moving.

Example #17

The system of example 16 wherein the mandrel further includes a first slip receiving portion, and a second slip receiving portion, wherein the slips are expandable from a position in the first slip-receiving portion in response to the power rod moving in an uphole direction until the slips are received in the second slip-receiving portion.

Example #18

The system of example(s) 16-17 further including multiple linkages, each linkage being coupled between a slip and the mandrel for causing the slips to expand.

Example #19

The system of example(s) 16-18 further including a wedge disposed at least partly between each of the plurality of slips and the mandrel for causing the plurality of slips to expand.

Example #20

The system of example(s) 16-19 wherein each of the slips includes a slip body and a slip insert shaped and sized to fit at least partially into the slip body, wherein the slip insert can be selected from among a plurality of slip inserts of varying characteristics.

The foregoing description of the examples, including illustrated examples, has been presented only for the purpose of illustration and description and is not intended to be exhaustive or to limit the subject matter to the precise forms disclosed. Numerous modifications, combinations, adaptations, uses, and installations thereof can be apparent to those skilled in the art without departing from the scope of this disclosure. The illustrative examples described above are given to introduce the reader to the general subject matter discussed here and are not intended to limit the scope of the disclosed concepts.

What is claimed is:

1. An assembly for use in a wellbore, the assembly comprising:

a body configured to couple to a linear actuator and defining an inner area;

a mandrel positionable in the inner area and configured to couple on a first end to a power rod of the linear actuator and on a second end to a shaft for a downhole tool, the mandrel including a first slip-receiving portion, a second slip-receiving portion, and a portion between the first slip-receiving portion and the second slip-receiving portion that has a greater diameter than the first slip-receiving portion and the second slip-receiving portion; and a slip that is (i) expandable from a position in the first slip-receiving portion to the portion of the mandrel between the first slip-receiving portion and the second slip-receiving portion such that the slip is engageable with an inner diameter of tubing or casing surrounding the body in response to the power rod moving in an uphole direction and (ii) receivable from the portion of the mandrel at the second slip-receiving portion such that the slip is disengageable with the tubing or casing, wherein no portion of the slip is receivable in the first slip-receiving portion when the slip is received in the second slip-receiving portion, and wherein no portion of the slip is receivable in the second slip-receiving portion when the slip is in the first slip-receiving portion.

2. The assembly of claim 1 wherein the slip comprises a plurality of slips distributed around the mandrel.

3. The assembly of claim 1 further comprising a wedge disposed partly between the slip and the first slip-receiving portion for causing the slip to expand.

4. The assembly of claim 3 further comprising an engagement mechanism that is responsive to movement of the power rod to engage the wedge and cause the wedge to move in an axial direction and cause the slip to expand.

5. The assembly of claim 1 wherein the slip comprises:

a slip body; and a slip insert shaped and sized to fit at least partially into the slip body, wherein the slip insert is replaceable within the slip body using one of a plurality of slip inserts comprising differing thicknesses, materials, gripping surfaces, or a combination thereof.

6. The assembly of claim 1 further comprising the linear actuator coupled to the body.

7. The assembly of claim 1 further comprising a shear release mechanism to release the mandrel in response to a jarring force.

8. A method of manipulating a downhole tool, the method comprising:

providing a mandrel including a first slip-receiving portion, a second slip-receiving portion, and a portion between the first slip-receiving portion and the second slip-receiving portion that has a greater diameter than the first slip-receiving portion and the second slip-receiving portion;

expanding a plurality of slips from a first slip-receiving portion of a mandrel to the portion of the mandrel between the first slip-receiving portion and the second slip-receiving portion to apply force to place the plurality of slips in direct physical contact with a tubular body, the mandrel connected to a power rod connected to a linear actuator;

applying a linear force to the power rod using the linear actuator, the linear force being applied to the downhole tool and further causing the mandrel to move relative to the plurality of slips and the tubular body; and retracting the plurality of slips towards the second slip-receiving portion of the mandrel to remove the direct physical contact between the plurality of slips and the tubular body, wherein no portion of each slip of the plurality of slips retracts towards the first slip-receiving portion while retracting towards the second slip-receiving portion, and wherein no portion of each slip of the plurality of slips is in the second slip-receiving portion while the plurality of slips are in the first slip-receiving portion.

9. The method of claim 8 wherein the plurality of slips is expanded by sliding a wedge.

10. The method of claim 9 wherein the wedge is slid by an engagement mechanism that is responsive to movement of the power rod.

11. The method of claim 8 further comprising releasing the mandrel in response to a jarring force.

12. The method of claim 11 wherein the mandrel is released by withdrawing a plurality of shear pins.

13. A system comprising:

a linear actuator coupled to or including a power rod;

a body configured to couple to the linear actuator and defining an inner area;

a mandrel positionable in the inner area, the mandrel coupled to the power rod on a first end and configured to couple to a shaft for a downhole tool on a second end, the mandrel including a first slip-receiving portion, a second slip-receiving portion, and a portion between the first slip-receiving portion and the second slip-receiving portion that has a greater diameter than the first slip-receiving portion and the second slip-receiving portion; and a slip that is (i) expandable from a position in the first slip-receiving portion to the portion of the mandrel between the first slip-receiving portion and the second slip-receiving portion such that the slip is engageable with an inner diameter of tubing or casing surrounding the body in response to the power rod moving in an uphole direction and (ii) receivable from the portion of the mandrel at the second slip-receiving portion such that the slip is disengageable with the tubing or casing, wherein no portion of the slip is receivable in the first slip-receiving portion when the slip is received in the second slip-receiving portion, and wherein no portion of the slip is receivable in the second slip-receiving portion when the slip is in the first slip-receiving portion.

14. The system of claim 13 further comprising a wedge disposed at least partly between the slip and the first slip-receiving portion for causing the slip to expand.

15. The system of claim 14 wherein the slip comprises:

a slip body; and a slip insert shaped and sized to fit at least partially into the slip body, wherein the slip insert is selectable from a plurality of slip inserts comprising different thicknesses, materials, gripping surfaces, or a combination thereof.

* * * * *